US005551792A

United States Patent [19]

Witmyer

[11] Patent Number: 5,551,792

[45] Date of Patent: Sep. 3, 1996

[54] CONNECTOR

[75] Inventor: Brian E. Witmyer, Lititz, Pa.

[73] Assignee: Armstrong World Industries, Inc., Lancaster, Pa.

[21] Appl. No.: 430,812

[22] Filed: Apr. 28, 1995

[51] Int. Cl.[6] ..... E04B 9/12

[52] U.S. Cl. ..... 403/241; 403/231; 403/230; 52/669; 52/665

[58] Field of Search ..... 403/241, 233, 403/231, 230, 181, 180; 52/665, 666, 667, 668, 669

[56] References Cited

U.S. PATENT DOCUMENTS 3,334,465 8/1967 Hoffmann, Jr. .
3,677,589 7/1972 Roles ..... 403/241 X
3,798,865 3/1974 Curtis .
3,998,419 12/1976 Semmerling .
4,641,987 2/1987 Schlegel .
5,195,289 3/1993 LaLonde et al. .

FOREIGN PATENT DOCUMENTS 260978 5/1963 Australia ..... 403/241

*Primary Examiner*—Anthony Knight

[57] ABSTRACT

A combination is disclosed wherein an inverted T-shaped ceiling runner is connected to a decorative element by a connector. The decorative element has parallel grooves into which an upper portion of the connector can be positioned in the grooves to hold the connector relative the decorative element. A lower portion of the connector extends down to the inverted T-shaped ceiling runner and is fastened to the vertical web thereof to position and hold the decorative element in a fixed relationship to the inverted T-shaped ceiling runner.

1 Claim, 1 Drawing Sheet

CONNECTOR

BACKGROUND OF THE INVENTION

1. Field of the Invention

The invention is directed to a connector designed to fasten a decorative/utilitarian ceiling element to a conventional ceiling runner.

2. Description of the Prior Art

U.S. Pat. No. 3,998,419 discloses a clip which is bolted to the web of a T-runner intermediate the ends thereof. The upper end of the clip is secured to a beam but does not include a member which can slide in grooves in the beam member which has no grooves.

U.S. Pat. Nos. 3,798,865 and 5,195,289 disclose clips connected to the web of a T-runner. The clips have flat members which slide into grooves in a trim member but the clips are connected to the ends of the T-runner.

U.S. Pat. No. 4,641,987 discloses a clip or connector for a suspended ceiling structure in which one end of the clip is a rectangle that slides into grooves in a ceiling runner and the other end of the clip is connected to a ceiling runner with screws.

U.S. Pat. No. 3,334,465 discloses a clip having two ends where one end slides into grooves in a ceiling runner and the other end is connected to a ceiling joist with a fastening element.

SUMMARY OF THE INVENTION

The invention is directed to the combination of an inverted T-shaped ceiling runner and a decorative/utilitarian element with the runner and decorative element being fastened together with a connector. The decorative element has a front side and a back side having two opposed facing parallel grooves. The connector has a flat plate-like portion sized to slip into the opposed facing parallel grooves and to be held therein. A second portion of the connector fastens to the plate-like portion and the runner to hold together the runner and decorative element.

The connector is fastened to the vertical web section of the inverted T-shaped ceiling runner. The ceiling runner is a typical ceiling runner which has an enlarged upper element and the connector must have an offset area which will permit the connector to rest against the vertical web of the runner to be fastened thereto yet pass around the enlarged bulb of the runner to then further connect with the decorative element which is positioned above the runner.

DESCRIPTION OF THE PREFERRED EMBODIMENT

Figure 2:
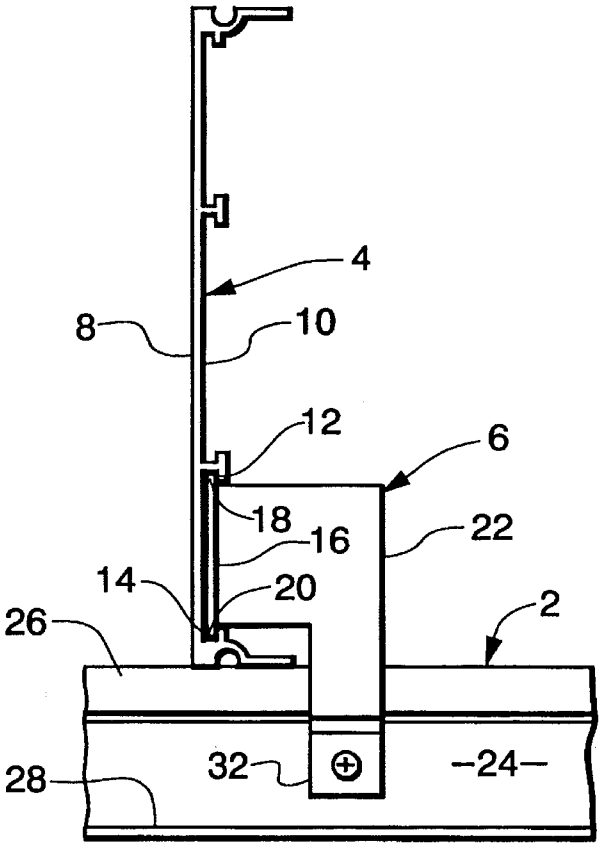
FIG. 2 is a side view of the structure of FIG. 1.
Figure 1:
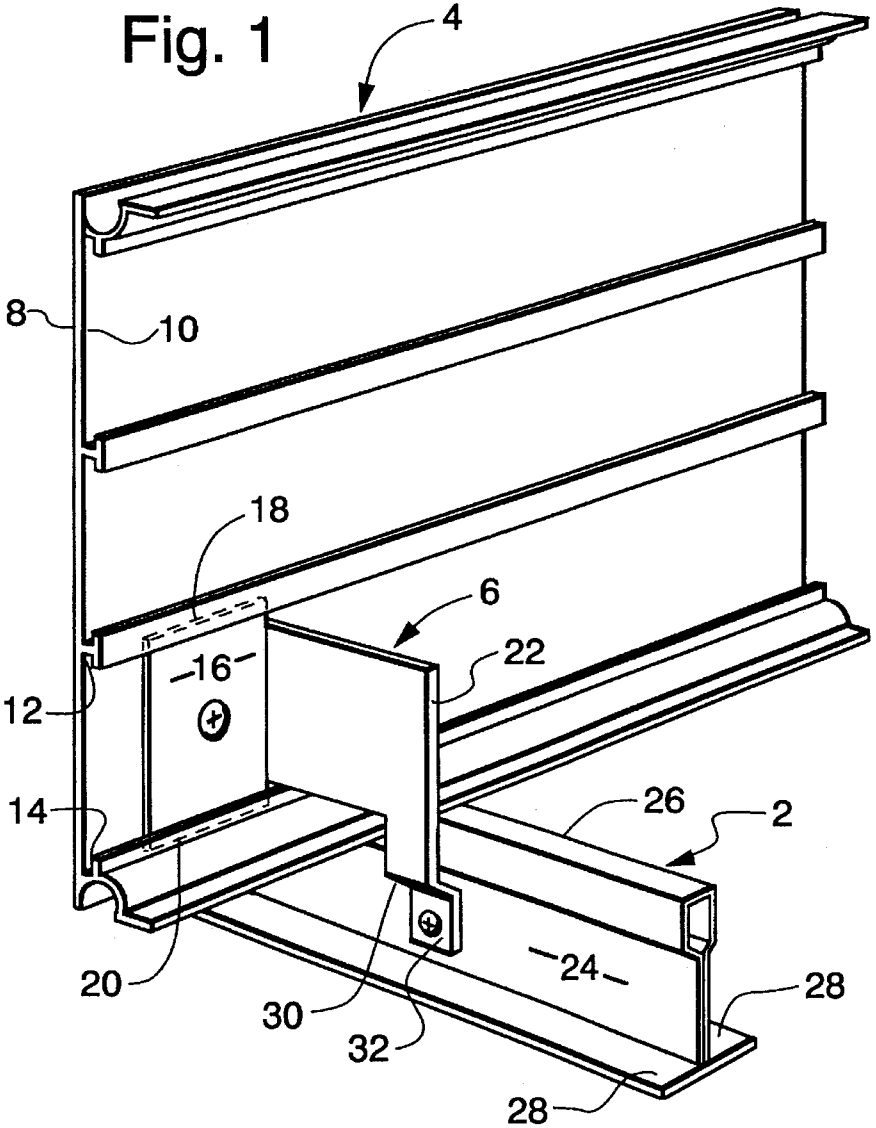
FIG. 1 is a perspective view of the invention.

The invention herein is the combination of an inverted T-shaped ceiling runner 2 with a decorative element 4 and the two fastened together by a connector 6. The inverted T-shaped ceiling runner is conventional in the art in that it has a vertical web 24 with an enlarged upper end 26 and horizontal flanges 28 at its lower end. The decorative element 4 is formed with a decorative or utilitarian side 8 and a back side 10. The back side 10 has two opposed facing parallel grooves 12 and 14. The side 8 may be exposed to view or used to form an interior wall in the ceiling.

The connector is formed of a flat plate-like portion 16 with two opposite sides 18 and 20. The two opposite sides 18 and 20 are sized so that the sides can slide into the ends of the grooves 12 and 14 or the sides can be placed in the area between the grooves and twisted to be inserted into the grooves thereby holding the connector in position relative the decorative element 4. The connector 6 is formed with a second section 22. This portion 22 is an integral part of the flat plate-like structure 16 and the two structures 16 and 22 are positioned at right angles to each other but capable of being bent to other angles. In use, the flat plate-like structure is normally positioned at the top of the second portion 22 of the connector. The second portion of the connector is generally an elongated element and, at its lower end where it fastens to the vertical web of the runner, it has an offset 30 so that the second portion can be positioned with its lower end 32 adjacent the vertical web of the runner to be fastened thereto yet still be able to swing out around the enlarged upper portion 26 of the runner to extend upward to the flat plate-like portion 16 which is positioned above the top of the runner and is located in the grooves 12 and 14 of the decorative element 4.

What is claimed is:

1. The combination of an inverted T-shaped ceiling runner, a decorative/utilitarian element and a connector fastening together said runner and said element, said element having a flat planar front side and a back side having two opposed facing parallel grooves, said connector having a flat plate-like portion with two opposed sides sized to fit into the two opposed facing parallel grooves and be held therein, a second portion of the connector being fastened to said connector flat plate-like portion and said runner, said connector flat plate-like portion and connector second portion form a one piece structure with the two portions positioned at a right angle to each other, said element being positioned above said runner and being at right angles to said runner, the runner having a vertical web sectional with an enlarged upper end adjacent said element and horizontal flanges on its lower end, said second portion of said connector being an elongated element and being fastened to the vertical web section, the second portion of said connector extending downward from said element to said runner and having an offset portion adjacent its point of connection to said vertical web section to permit the second portion to extend past the enlarged upper end of said runner.

* * * * *